US005758531A

United States Patent [19]

Graf

[11] Patent Number: 5,758,531

[45] Date of Patent: Jun. 2, 1998

[54] PEENING ARTICLE WITH PEENING PARTICLES ARRANGED TO MINIMIZE TRACKING

[75] Inventor: Timothy L. Graf, Lake Elmo, Minn.

[73] Assignee: Minnesota Mining and Manufacturing Company, St. Paul, Minn.

[21] Appl. No.: 842,579

[22] Filed: Apr. 15, 1997

Related U.S. Application Data

[63] Continuation of Ser. No. 639,140, Apr. 26, 1996, Pat. No. 5,619,877.

[51] Int. Cl.[6] ..... B21J 5/00

[52] U.S. Cl. ..... 72/53; 451/465

[58] Field of Search ..... 72/53; 451/464, 451/465, 466, 469

[56] References Cited

U.S. PATENT DOCUMENTS

| | | | |
|---|---|---|---|
| 3,638,464 | 2/1972 | Winter et al. | 72/53 |
| 3,648,498 | 3/1972 | Voss et al. | 72/53 |
| 3,834,200 | 9/1974 | Winter | 72/53 |
| 3,857,750 | 12/1974 | Winter et al. | 161/87 |
| 4,441,349 | 4/1984 | Symons | 72/53 |
| 4,481,802 | 11/1984 | Harman et al. | 72/53 |
| 5,152,917 | 10/1992 | Pieper et al. | 51/295 |
| 5,179,852 | 1/1993 | Lovejoy et al. | 72/53 |
| 5,203,189 | 4/1993 | Lovejoy et al. | 72/53 |
| 5,284,039 | 2/1994 | Torgerson | 72/53 |
| 5,298,303 | 3/1994 | Kerr et al. | 428/35.7 |
| 5,435,816 | 7/1995 | Spurgeon et al. | 51/295 |
| 5,437,754 | 8/1995 | Calhoun | 156/231 |
| 5,487,293 | 1/1996 | Lovejoy | 72/53 |
| 5,619,877 | 4/1997 | Graf | 72/53 |

*Primary Examiner*—David Jones
*Attorney, Agent, or Firm*—James J. Trussell

[57] ABSTRACT

A peening particle support having a plurality of asymmetrically arranged peening particles positioned to minimize tracking on a workpiece. The peening particles are attached to an exposed surface of the peening particle support. The peening particle arrangement includes three or less peening particles with substantially the same non-zero radial distance from a center of the exposed surface. The peening particles are preferably arranged in at least one linear array of peening particles.

26 Claims, 8 Drawing Sheets

PEENING ARTICLE WITH PEENING PARTICLES ARRANGED TO MINIMIZE TRACKING

This is a continuation of application Ser. No. 08/639,140 filed Apr. 26, 1996, now U.S. Pat. No. 5,619,877.

FIELD OF THE INVENTION

The present invention relates to a peening article with optimized placement of the peening particles, and in particular, to an article having peening particles arranged to minimize tracking.

BACKGROUND OF THE INVENTION

Conventional shot peening or blasting is often used to treat concrete or metal by blowing or mechanically impelling particles of steel or iron against a surface. On metal surfaces, the individual particles produce shallow, rounded overlapping dimples in the surface. Conventional shot peening, however, requires extensive blasting equipment. For applications requiring mobility, this blasting equipment is not particularly mobile and the particles are not easily collected for recirculation.

The use of rotating flaps with peening particles attached thereto, known as rotary peening, has proven to be effective for stress relief, surface conditioning, and removal of coatings from surfaces. The process eliminates the use of free shot to peen the surface. Additionally, no solvents are required to loosen surface coatings prior to the rotary peening operation.

A rotary peening apparatus 10 (shown in FIG. 1) includes a cylindrical hub 12, including hub ends 14, 16, and opposing mounting flanges 18. The hub 12 is adapted for mounting on a shaft or arbor (not shown), for rotation therewith about a central axis A—A. The hub 12 includes a plurality of guides 22 that are spaced about the perimeter of the hub 12 to provide flap slots 24, which extend parallel to the axis A—A and are adapted to receive retaining ends 17 of peening flaps 30, such as are illustrated in FIG. 2. Disposed within the retaining ends 26 are a plurality of keeper pins that assist in retaining the peening flaps 30 within the flap slot 24. Several flaps are typically arranged in a side by side relationship within each flap slot 24.

One or more peening particle supports 34 is attached to a distal end 32 of a peening flap 30 by shank 35, as illustrated in FIG. 2. Each peening particle support 34 includes a plurality of peening particles 42 protruding therefrom, which particles impact the surface being treated when the apparatus is rotated. The peening particle support 34 simulate the individual particles of conventional shot peening. Such peening flaps are available from Minnesota Mining and Manufacturing Company, of St. Paul, Minn., and are known commercially as Heavy Duty Roto Peen flaps, Type B, Type C, and Type D. The general construction of the peening flap is further described in U.S. Pat. No. 5,203,189 and the construction of the peening particle support bases is further described in U.S. Pat. No. 5,179,852.

One potential disadvantage of a rotary peening process arises if the peening particle support 34 are circumferentially aligned with each other. If the peening particle support 34 are spaced evenly across the face of the peening flap, an area on the surface or workpiece that is between adjacent peening particle support 34 may not be contacted. Consequently, such an arrangement can result in a plurality of ridges or troughs on the surface or workpiece. While a grooved surface finish may be desirable for some applications, such as slip resistance and water drainage, it is unacceptable for other applications.

It has been found that increasing the number of peening particles on a particular peening particle support 34 produces a smoother surface with less tracking. The tradeoff, however, is that increasing the number of peening particles on the peening particle support 34 tends to produce a less aggressive abrasive and increases the required dwell time to achieve the same level of surface treatment. Examples of prior art arrangements of peening particles are shown in FIGS. 3A–3D. As is clear from FIGS. 3A–3D, the peening particles are arranged symmetrically across the surface of the peening particle support 34.

Alternately, a spacer ring 50 having circumferentially spaced pin members 52 that are adapted to cooperate with the flap slots 24 and with the peening flaps 30 may be attached to the hub 12 illustrated in FIG. 1. The circumferentially arranged pins 52 are designed to offset the peening flaps 30 with respect to one another to minimize tracking. The spacer ring 50 is further discussed in U.S. Pat. No. 5,284,039. While the above configuration has significantly improved the surface finish created using a rotary peening process, further improvements are desirable.

SUMMARY OF THE INVENTION

The present invention is directed to a peening particle support having a plurality of peening particles arranged to minimize tracking on a workpiece. The peening particle arrangement is preferably asymmetrical.

The peening particle support has a plurality of peening particles on an exposed surface thereof in an arrangement that minimizes tracking upon a workpiece. The peening particle arrangement preferably includes three or less peening particles having substantially the same non-zero radial distance from a center of the exposed surface. In an alternate embodiment, the peening particle arrangement has two or less peening particles having substantially the same non-zero radial distance from the center of the exposed surface. In particular, when counting the three or less or two or less peening particles, a zero-radius placement of a particle is excluded. In yet another embodiment, each peening particle has a substantially different radial distance from the center of the exposed surface. Preferably, no peening particles are located at the center of the exposed surface.

The peening particle arrangement further includes arranging the peening particles into at least one generally linear array. The at least one linear array preferably has at least three peening particles. In an alternate embodiment, the at least one linear array contains all of the peening particles on the exposed surface. The peening particles in a linear array on a 1.27 cm (0.5 inch) diameter peening particle support preferably fall within 1.27 mm (0.050 inch), more preferably within 0.51 mm (0.020), and most preferably within 0.254 mm (0.010 inch) of a best fit line. In an alternate embodiment, a peening particle is within a linear array if its distance from a best fit line is less than about 20% of the radial spacing of the furthest out point from the center of the exposed surface.

The distance of the peening particles from a best fit line is preferably less than 0.51 mm for a peening particle support containing six peening particles; less than 0.381 mm for a peening particle support containing nine peening particles; less than 0.254 mm for a peening particle support containing fourteen peening particles; and less than 0.127 mm for a peening particle support containing twenty-one peening particles.

The exposed surface may be a generally circular shape. The exposed surface preferably has a diameter of about 1.04 cm to 1.27 cm (0.410 to 0.500 inches). The peening particles have a diameter of about 1.02 mm to 1.63 mm (0.040 to 0.064). It will be understood that the diameter of the peening particle support and peening particles may vary without departing from the scope of the present invention.

Two or more peening particle supports may be arranged to randomize the location of the peening particles. Adjacent peening particle supports or peening particle supports in different rows on a rotary peening device may vary with regard to the number, size or arrangement of the peening particles. Additionally, the rotational orientation of an individual peening particle support with respect to the peening flap is preferably randomized.

The plurality of peening particles are preferably between six and twenty one peening particles, although it will be understood that the precise number may vary without departing from the present invention. The peening particles are preferably metallurgically attached to the exposed surface.

The points tend to be distributed on the peening particle support on an approximately volumetric basis.

The present invention is also directed to an elongated strap of a flexible tear-resistant material having the rotory peening particle support configured according to the present invention attached to a distal end thereof The present invention is also directed to a rotary peening apparatus having a plurality of the peening particle supports.

As used herein:

Asymmetrical refers to the location of the peening particles relative to the center of the peening particle support.

Center of the Peening Particle Support or Center of the Exposed Surface refers to the virtual rotation point of the peening particle support.

Peening Particle Support refers to an article with a plurality of bumps or protrusions on an exposed surface thereof.

Tracking refers to a non-uniformity of surface impacts by the peening particles generally parallel to the direction of traverse of the peening apparatus, often characterized by generally parallel streaks or score lines.

DETAILED DESCRIPTION OF THE PREFERRED EMBODIMENTS

Figure 1:
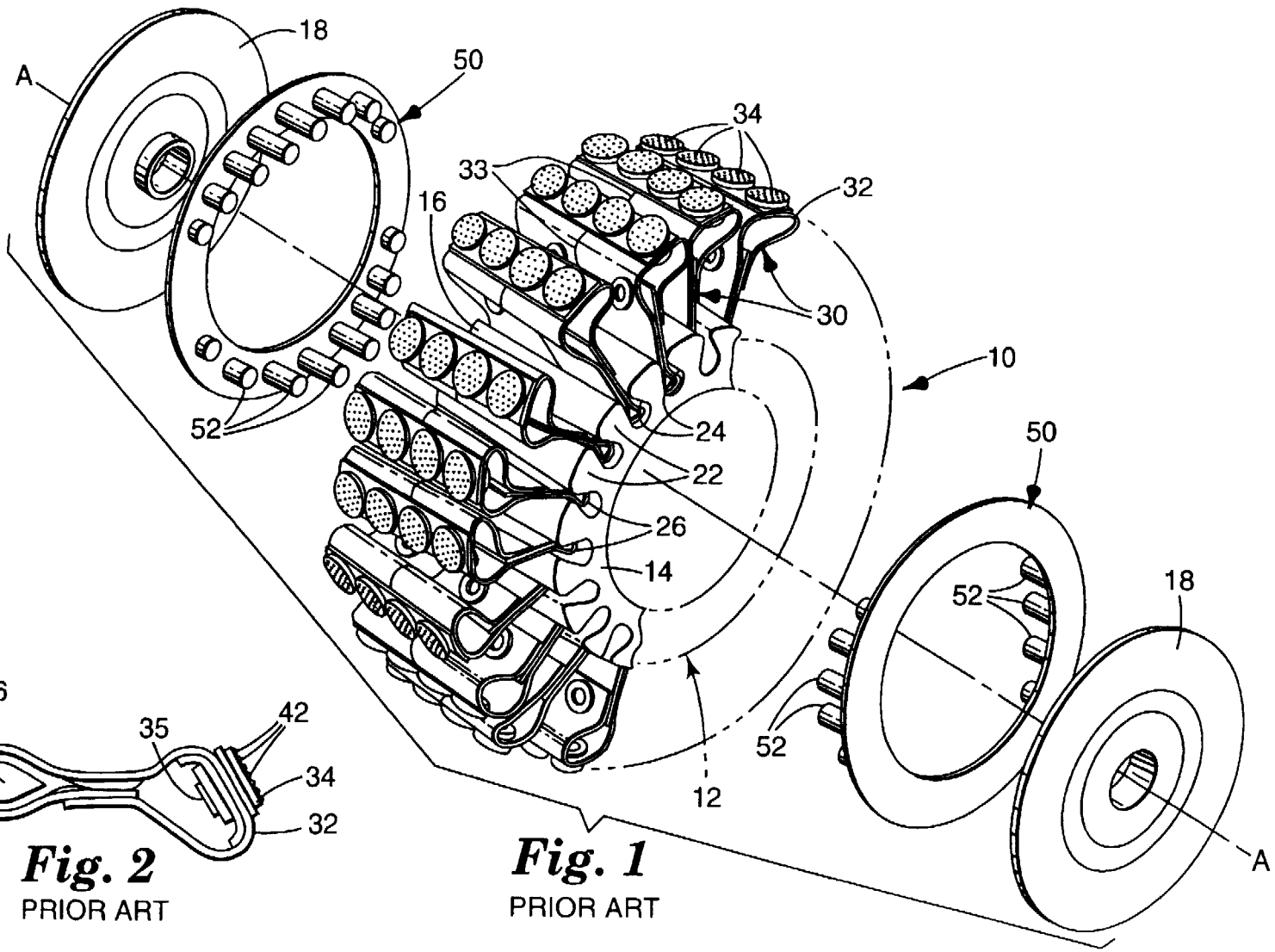
Fig. 1 PRIOR ART
FIG. 1 illustrates an exemplary rotary peening apparatus.
Figure 2:
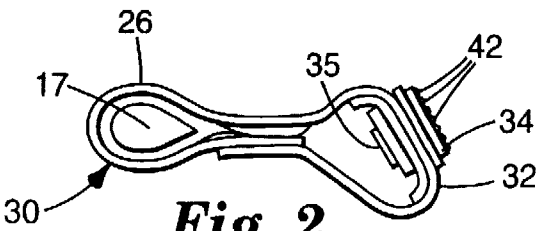
Fig. 2 PRIOR ART
FIG. 2 illustrates an exemplary peening flap containing a peening particle support.

The present invention relates to a peening particle support 34 having a plurality of peening particles 42 arranged to minimize tracking on a workpiece. The material of the peening particle support 34 preferably is able to withstand high cyclic bending and impact stresses while resisting deformation during use. It is important to note that the bending and impact stresses during use are cyclic (i.e., repeated) since ultimate separation of head from shank 35 of the peening particle support 34 is the result of fatigue (cyclic stresses causing failure at lower stress levels than would be expected to cause failure under static loading). In addition, the peening particle support material preferably is sufficiently ductile to allow the required deformation to be cold formed and for fastening to the peening flap 30. When using previously known elongated strap materials with rivet-type support bases made from low carbon steel such as an AISI 1006 (American Iron and Steel Institute) carbon steel it was found that the peening flap material required replacement prior to replacement of the peening particle supports 34. However, with the use of linear polyurethane elastomers as coating material for the fabric scrim, the low carbon steel peening particle supports have become the life limiting feature of the flaps used for high-intensity peening.

The upper exposed surface of the low carbon steel becomes severely hardened during the brazing of the peening particles to the peening particle support. When a nickel (Ni) alloy brazing compound is used to attach peening particles to the peening particle support, the surface of the peening particle support 34 that is exposed to the braze alloy is hardened as well as a region extending about 0.5 mm below this surface. The hardness of the peening particle support 34 is more affected, however, by the lower carbon (C) content of low carbon steels, which is insufficient (under normal circumstances) to allow metallurgic transformation to a harder structure by heat treatment. This lower hardness may manifest itself in the abrasive peening particles being forced toward the center of the peening particle support, creating a flattened surface profile, and consequently reducing the rate of scale or concrete removal during peening.

For this reason, peening particle supports 34 (prior to brazing) are preferably carbon steels having from about 0.08 to about 0.34 weight percent carbon, more preferably AISI 1021 steel (0.18–0.23 weight % Carbon) having from about 0.0005% to about 0.003 by weight boron (B) added thereto. 10B21 steel allows for hardening by heat treatment (via a metallurgical transformation), and exhibits good "hardenability", that is, it can be through hardened while 1006 cannot. It appears that 10B21 contains just enough carbon and boron (preferably at least 0.002 wt % Boron) to be a hardenable alloy via heat treatment while having the maximum allowable carbon content to be formed using the current two stroke cold heading (forming) machine used to make the peening particle support 34, and the machine used to flare the shank 35 of the peening particle support 34.

In order to minimize cracking of the peening particle support, a minimum separation between adjacent peening particle should be maintained. The amount of that separation is dependent upon the diameter of the peening particles and the peening particle support 34, the material used to construct the peening particle support, and a variety of other design and application parameters.

Tempering the peening particle support 34 via heat treatment after brazing the peening particles 42 thereto can affect hardness. Depending on the power and of type machine used to flare the shank 35 of the peening particle support 34, the preferred center hardness is produced by adjusting the tempering temperature. A high tempering temperature (e.g. 700° C.) produces a hardness of about 70–100 HRB (Rockwell Hardness, B scale), while lowering the tempering temperature to about 400° C. produces hardness of about 30–40 HRC (Rockwell Hardness, C scale). Thus, one preferred tempering temperature ranges from about 375° C. to about 425° C., more preferably about 400° C., when a harder peening particle support 34 is desired. A radial riveting machine known under the trade name "Baltec", available from Bracker Corporation, Pittsburgh, Pa., which uses a maximum riveting pressure of 1700 daN, may be used for peening particle support 34 tempered at high temperatures, while low temperature tempering may require higher riveting pressures.

The peening particles 42 are typically of a refractory-hard, impact fracture-resistant material, and they are metallurgically joined to the exposed face of the peening particle support 34. Refractory-hard cemented tungsten carbide shot known under the trade name "Grade 44A", available from Carboloy, Inc. (now known as Sandvik Hard Materials), of Warren, Mich., have been found to have an excellent combination of the preferred properties. This particular tungsten carbide includes a binder having from about 8–12 weight percent Co. However, other cemented carbides, for example, TiC and TaC; ceramic materials, for example, $B_4C$ and hot-pressed alumina as well as other wear-resistant, refractory-hard peening particles are also useful. The peening particle support 34 and the peening particles 42 must, of course, be compatible for metallurgical joining. Such bonding may be accomplished by brazing, casting the peening particles in place in the support base, sintering, or any other available method for forming the required bond. Preferred is brazing, using a brazing alloy having about 80–85% by weight Ni, about 3% B, about 7% Cr, about 3.5% Fe, about 4.5% Si, with traces of Al, C, Co, P, S, Se, Ti, and Zr. One commercially available brazing alloy meeting these specifications is that sold under the trade name "Amdry 770", a powder commercially available from Sulzer Plasma Technik, Inc., Troy, Mich. This brazing alloy has 0.05% maximum Al; 2.75% minimum to 3.50% maximum B; 0.06 maximum C; 0.10 maximum Co; 5.0% minimum to 8.0 maximum Cr; 2.5% minimum Fe to 3.5 maximum Fe; 0.02% maximum P; 0.02 maximum S; 4.00% minimum to 5.00 maximum Si; 0.005 maximum Se; 0.05 maximum Ti; 0.05 maximum Zr; balance Ni. This brazing alloy has powder particle size distribution of 90% minimum at −140 mesh (−105 micrometers) and 50% maximum at −325 mesh (+45 micrometers).

Other braze alloys are possible for use but have limitations which make their use less than optimal. Copper braze alloys are limited by several factors, including their high fluidity, which could lead to infiltration of copper into the tungsten carbide shot. The vaporization temperature of liquid copper braze alloys is low enough in vacuum brazing furnaces so that argon atmospheres must be used. Silver braze alloys have poor mechanical properties and are not suitable for most abrasives applications. They also melt around 850° C. and would become remelted during subsequent heat treatment processes. Thus, nickel braze alloys are preferred. They are easy to use, having wide melting range, and become fully liquid at about 1000° C. because of the Si and B. These elements diffuse into the base metal or vaporize, however, and remelting requires a considerably higher temperature.

The diameter of the peening particles 42 and the dimples into which they are placed can range from about 0.010 to 0.080 inches (0.252 to 2.03 mm), more preferably from about 0.040 to 0.064 inches (1.02 to 1.63 mm). The larger diameters are used when more aggressive peening action is required, such as to remove heavy oxide scale or coatings from metal, and concrete surface preparation. The exposed surface of peening particle support 34 may have a diameter of about 0.500 inches (1.27 cm) to 0.410 inches (1.04 cm). Other head diameters may be preferable depending on the particular operation.

A commercial convention has been developed to identify various peening particle supports 34 provided on Heavy Duty Roto Peening Flaps available from Minnesota Mining and Manufacturing Company, St. Paul, Minn. as follows: Type "A" particle support has a head diameter of 0.500 inches (1.27 cm) with six peening particles having a diameter of 0.064 inches (1.6 mm); Type "B" particle support has a head diameter of 0.410 inches (1.04 cm), with nine peening particles of 0.044 inch (1.1 mm) diameter; Type "C" particle support has a head diameter of 0.465 inches (1.18 cm) with nineteen peening particles of 0.044 inch (1.1 mm) diameter, and Type "D" particle supports have a head diameter of 0.500 inch (1.27 cm) with 12 peening particles of 0.064 inch (1.6 mm) diameter. It will be appreciated that variations in peening particle size, pattern, etc., are within the scope of the present invention. It will be understood that a variety of other techniques and materials may be used for constructing the peening particles 42 and peening particle supports 34, such as disclosed in U.S. Pat. No. 5,179,852 issued to Lovejoy et al. on Jan. 19, 1993, and U.S. Pat. No. 5,284,039 issued to Torgerson on Feb. 8, 1994.

The preferred elongated peening strap is a coated fabric having a plurality of coating layers, at least one of these layers including a linear polyurethane elastomer. The preferred linear polyurethane elastomer is polycarbonate-polyether polyurethane made from the reaction product of a mixture of polycarbonate polyol and a polyether polyols, diisocyanate compound, and first and second extenders. The strap portion of the peening flap 30 illustrated in FIG. 1 is preferably approximately 2.00 inches (5.08 cm) wide by 5.50 inches (13.97 cm) long prior to assembly. Upon assembly, the peening flap 30 is preferably approximately 2.00 inches (5.08 cm) wide by 1.875 inches (4.76 cm) long. A slit 33 extending approximately 1.313 inches (2.67 cm) from the direction of peening particle supports 34 may optionally be formed in the flap 30. The straps on each side of slit 33 are each approximately 0.500 inches (1.27 cm) wide by 1.00 inch (2.54 cm) long. Preferred flap construction and assembly means are disclosed in U.S. Pat. No. 5,487,293 issued to Lovejoy.

The peening particle supports are preferably formed using cold forming and heat treating procedures used to produce previously known peening particle supports. Shank portion 35 of the peening particle support 34 may be formed from wire stock of AISI 1006 to 1010 steel by a single-die two-punch process as follows. The wire stock is the same diameter as the diameter of the shank 35. The wire stock is punched twice against the die to form the peening particle support 34. After forming the peening particle support 34, it is preferable to stress relieve it by heating it in a vacuum at 1150°–1200° F. (620°–650° C.) for 1.5 hours.

The locations of the peening particle support 34 heads on the elongated straps and each point located on the exposed surface is accurately controlled during manufacturing. The rotational orientation of each peening particle support 34 is preferably random. In particular, the shank 35 permits the peening particle support 34 to be attached to the peening flap 30 at any orientation. It will be understood, however, that the rotational orientation of the peening particle supports 34 may be controlled, such as arranging them on fixed intervals.

The optimum arrangement to minimize tracking of the present invention is primarily a function of the radial spacing also referred to herein as the peening particle radius, of the peening particles relative to the center of the peening particle support as evaluated on a volumetric basis. In particular, preferably no more than three, more preferably no more than two of the peening particles should have substantially the same non-zero radial spacing from the center of the peening particle support in other words, at each respective non-zero peening particle radius at which there is at least one peening article, there are preferably between 1 and 3, and more preferably between 1 and 2, peening articles. In particular, when counting the three or less or two or less peening particles, a peening particle at the zero radius location is excluded. Additionally, when counting the three or less or two or less peening particles, the peening particles typically have comparable impact performance and abrasive capacity. Most preferably, none of the peening particles have substantially the same radial spacing from the center of the peening particle support. As will be explained below, not locating a peening particle at the center of the peening particle support is a corollary to the rule of varying the radial spacing.

A secondary factor is to arrange the peening particles into a single linear array, or as few arrays as possible. Manufacturing limitations and design limitations discussed below may prevent locating all of the peening particles in a single array. For example, the peening particles can not be located too close to the edge of the exposed surface of the peening particle support. Additionally, adjacent peening particles require a minimum separation to avoid cracking the peening particle support during use.

A third factor yielding some incremental improvement involves maximizing the linear spacing between peening particles. In particular, uniform distribution on a volumetric basis of the peening particles across the exposed surface tends to reduce tracking. Applicants have found that application of this third factor provides minimal overall improvement in tracking profiles.

Figure 4A:
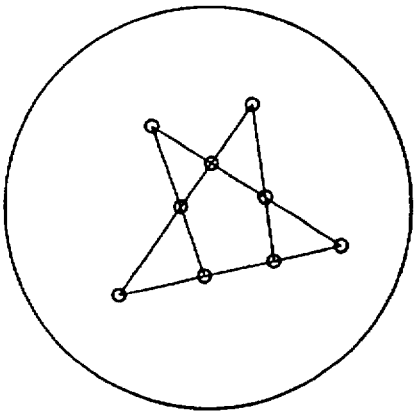
FIGS. 4A–4F illustrate exemplary embodiments of 9 peening particles arranged on a circular peening particle support.
Figure 4B:
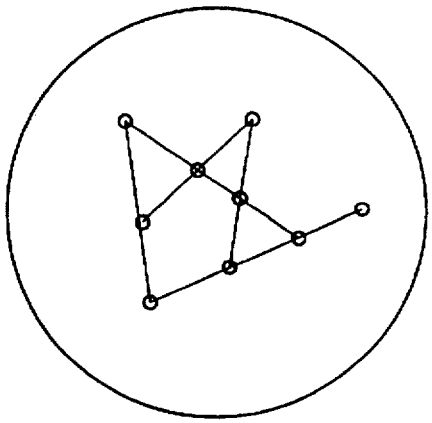
Figure 4C:
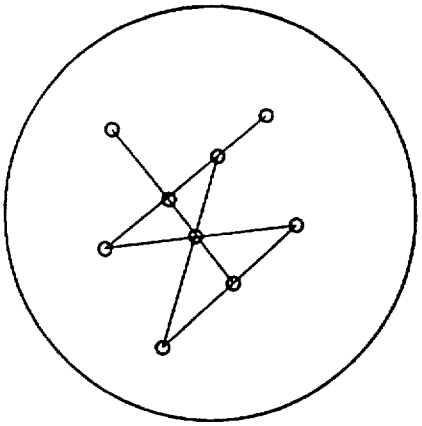
Figure 4D:
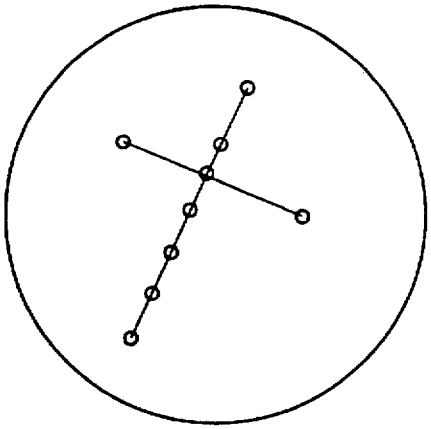
Figure 4E:
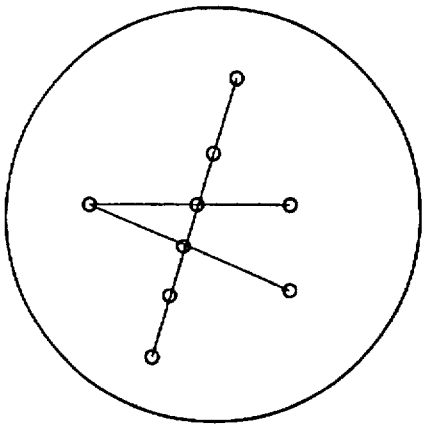
Figure 4F:
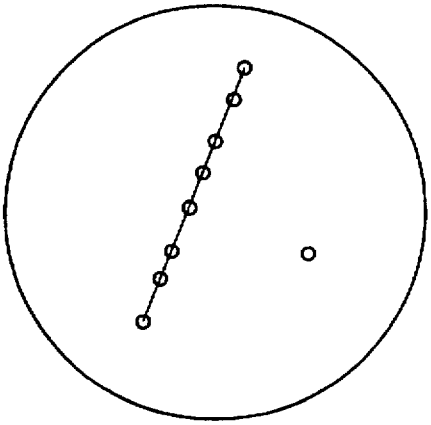
Figure 5A:
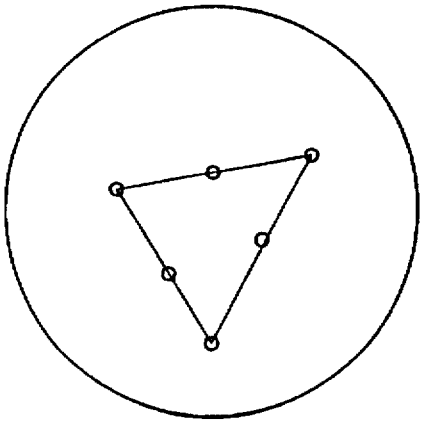
FIGS. 5A–5D illustrate exemplary embodiments of 6 peening particles arranged on a peening particle support.
Figure 5B:
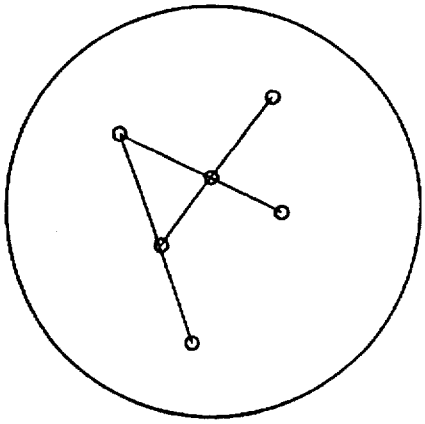
Figure 5C:
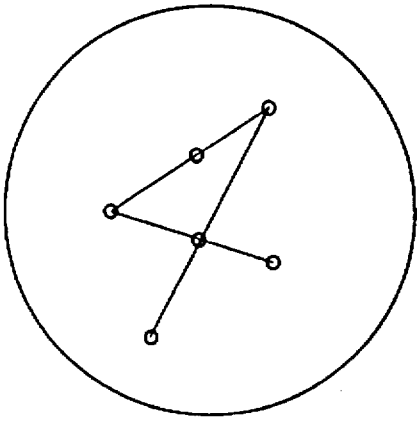
Figure 5D:
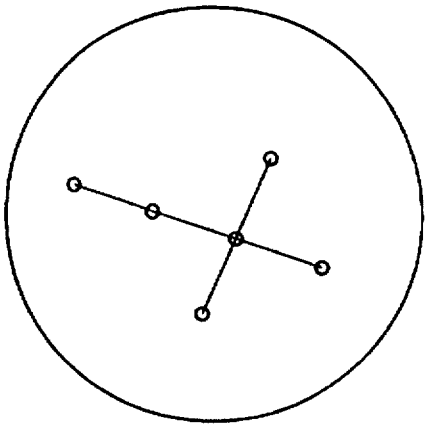

As will be clear to one skilled in the art, the three factors are in tension. For example, FIG. 4F illustrates an arrangement that attempts to locate all nine peening particles in a single linear array. The third factor, however, requires maximum linear spacing between the individual peening particles so that a single peening particle is located outside the linear array. Consequently, the reduction in tracking resulting from locating the last point within the array is not as great as the reduction in tracking resulting from maximizing the spacing between the peening particles.

Exemplary arrangements of the peening particles on the exposed surface illustrated in FIGS. 4A–4F are designed to minimize tracking on the surface or workpiece. The arrangement of the nine peening particles on each of the peening particle supports are arranged in a plurality of generally linear arrays. The arrays are designated by a series of imaginary lines connecting the peening particles. The lines are for illustration only and form no part of the final article. Each of these arrays typically includes three or more peening particles, with the exception of FIG. 4F.

Each of the peening particles preferably has a different radial distance from the center of the exposed surface. Preferably, none of the peening particles are located in the center of the exposed surface. The location of each of the peening particles in the embodiments illustrated in FIGS. 4A–4F are set forth in Table 1 below in polar coordinates. The radius is provided in both inches and millimeters.

TABLE 1

| Design | | 1 | 2 | 3 | 4 | 5 | 6 | 7 | 8 | 9 |
|---|---|---|---|---|---|---|---|---|---|---|
| 4A | Radius | .071 in | .138 in | .054 in | .124 in | .156 in | .086 in | .105 in | .171 in | .036 in |
| | | 1.80 mm | 3.51 mm | 1.37 mm | 3.15 mm | 3.96 mm | 2.18 mm | 2.67 mm | 4.34 mm | .91 mm |
| | Angle | 9.3 | 67.3 | 87.7 | 125.9 | 224.6 | 266.5 | 320.6 | 343.8 | 181.9 |
| 4B | Radius | .032 in | .0536 in | .0714 in | .0881 in | .1044 in | .1208 in | .1376 in | .155 in | .173 in |
| | | .813 mm | 1.36 mm | 1.81 mm | 2.24 mm | 2.65 mm | 3.07 mm | 3.50 mm | 3.94 mm | 4.39 mm |
| | Angle | 27.14 | 113.3 | 283.35 | 190. | 340.57 | 69.32 | 235.91 | 134.54 | .5 |
| 4C | Radius | .033 in | .0541 in | .0709 in | .0881 in | .1049 in | .1348 in | .1376 in | .1575 in | .173 in |
| | | .84 mm | 1.37 mm | 1.80 mm | 2.24 mm | 2.66 mm | 3.42 mm | 3.50 mm | 4.00 mm | 4.39 mm |
| | Angle | 236.4 | 161.48 | 82.6 | 287.79 | 352.92 | 198.4 | 61.07 | 139.12 | 250.26 |
| 4D | Radius | .03 in | .0512 in | .0692 in | .0863 in | .1036 in | .1214 in | .1399 in | .1594 in | .18 in |
| | | .76 mm | 1.30 mm | 1.76 mm | 2.20 mm | 2.63 mm | 3.08 mm | 3.55 mm | 4.05 mm | 4.57 mm |
| | Angle | 170.0 | 101.0 | 221.0 | 85.0 | 359.0 | 232.0 | 141.0 | 76.0 | 237.0 |
| 4E | Radius | .025 in | .0539 in | .075 in | .0943 in | .1129 in | .1315 in | .1504 in | .1698 in | .19 in |
| | | .64 mm | 1.37 mm | 1.91 mm | 2.40 mm | 2.87 mm | 3.34 mm | 3.82 mm | 4.31 mm | 4.83 mm |
| | Angle | 148.0 | 226.0 | 91.0 | 8.0 | 242.0 | 315.0 | 175.0 | 81.0 | 247.0 |
| 4F | Radius | .03 in | .0512 in | .0692 in | .0863 in | .1036 in | .1214 in | .1399 in | .1594 in | .18 in |
| | | .76 mm | 1.30 mm | 1.76 mm | 2.19 mm | 2.63 mm | 3.08 mm | 3.55 mm | 4.05 mm | 4.57 mm |
| | Angle | 166.0 | 106.0 | 223.0 | 90.0 | 232.0 | 336.0 | 81.0 | 238.0 | 79.0 |

Each of the nine point designs set forth in Table 1 was evaluated to determine the average distance from an ideal best-fit line. Point within 0.254 mm (0.010 inches) of an ideal line were considered part of that linear array. The average distance in millimeters from the best fit line for each line in the designs is summarized in Table 2 below.

TABLE 2

| Design | Line 1 | Line 2 | Line 3 | Line 4 | Line 5 | Line 6 |
|---|---|---|---|---|---|---|
| 4A | 0.0 mm | 0.0025 mm | 0.0 mm | 0.0 mm | 0.0 mm | 0.0 mm |
| 4B | 0.0 mm | 0.0025 mm | 0.0 mm | 0.0457 mm | 0.0203 mm | |
| 4C | 0.0152 mm | 0.0330 mm | 0.0076 mm | 0.0102 mm | 0.0 mm | |
| 4D | 0.0432 mm | 0.0152 mm | | | | |
| 4E | 0.0025 mm | 0.0279 mm | 0.0254 mm | | | |
| 4F | 0.0127 mm | | | | | |

FIGS. 5A–5D illustrate exemplary embodiments of six peening particles arranged on the exposed surface of a peening particle support. The specific locations of the peening particles in polar coordinates are provided in Table 3 below.

TABLE 3

| Design | | 1 | 2 | 3 | 4 | 5 | 6 |
|---|---|---|---|---|---|---|---|
| 5A | Radius | .045 in | .0722 in | .0954 in | .1176 in | .1396 in | .162 in |
| | | 1.14 mm | 1.83 mm | 2.42 mm | 2.99 mm | 3.55 mm | 4.11 mm |
| | Angle | 88.0 | 328.0 | 236.0 | 169.0 | 29.0 | 270.0 |
| 5B | Radius | .03586 in | .08388 in | .16348 in | .1556 in | .14322 in | .07635 in |
| | | .91 mm | 2.13 mm | 4.15 mm | 3.95 mm | 3.64 mm | 1.94 mm |
| | Angle | 90.71 | 355.18 | 262.0 | 62.46 | 140.44 | 217.5 |
| 5C | Radius | .0375 in | .0709 in | .0972 in | .1216 in | .1457 in | .17 in |
| | | .95 mm | 1.80 mm | 2.47 mm | 3.09 mm | 3.70 mm | 4.32 mm |
| | Angle | 245.0 | 104.0 | 321.0 | 180.0 | 61.0 | 245.0 |
| 5D | Radius | .04 in | .0721 in | .0979 in | .122 in | .1459 in | .17 in |
| | | 1.02 mm | 1.83 mm | 2.49 mm | 3.10 mm | 3.71 mm | 4.32 mm |
| | Angle | 313.0 | 177.0 | 45.0 | 264.0 | 334.0 | 168.0 |

Each of the six point designs set forth in Table 3 was evaluated to determine the average distance from one or more ideal lines intersecting the points. Point within 0.51 mm (0.020 inches) of an ideal line were considered part of that linear array. The average distance in millimeters from the best fit line for each line in the designs is summarized in Table 4 below.

TABLE 4

| Design | Line 1 | Line 2 | Line 3 |
|---|---|---|---|
| 5A | 0.0025 mm | 0.0127 mm | 0.0457 mm |
| 5B | 0.0025 mm | 0.0102 mm | 0.0229 mm |
| 5C | 0.0127 mm | 0.0051 mm | 0.0483 mm |
| 5D | 0.0051 mm | | |

Table 5 below contains exemplary embodiments of fourteen peening particles arranged on the exposed surface of a peening particle support to minimize tracking on a workpiece, as illustrated in FIGS. 6A–6F. The location of each peening particle, given in polar coordinates, are set forth in Table 5. Points within 0.254 mm (0.010 inches) of an ideal line were considered part of that linear array. The points were generally in the range of 0 to 0.1168 mm (0.0046 inches) from the ideal line.

Table 6 below contains exemplary embodiments of twenty one peening particles arranged on the exposed surface of a peening particle support to minimize tracking on a workpiece, as illustrated in FIGS. 9A–9E. The location of each peening particle, given in polar coordinates, are set forth in Table 6. Points within 0.127 mm (0.005 inches) of an ideal line were considered part of that linear array. For FIGS. 9A–9D, the points were generally in the range of 0 to 0.0559 mm (0.0022 inches) from the ideal line. For FIG. 9E, the points were generally in the range of 0 to 0.094 mm (0.0037 inches).

Figure 6A:
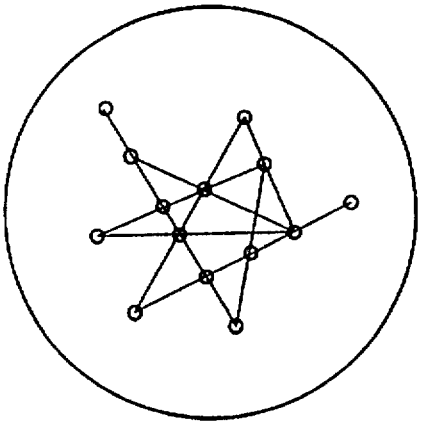
FIGS. 6A–6F illustrate exemplary embodiments of 14 peening particles arranged on a peening particle support.
Figure 6B:
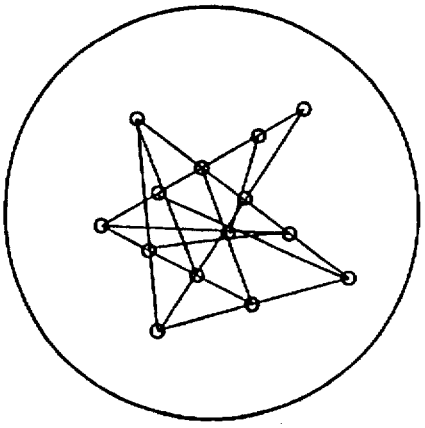
Figure 6C:
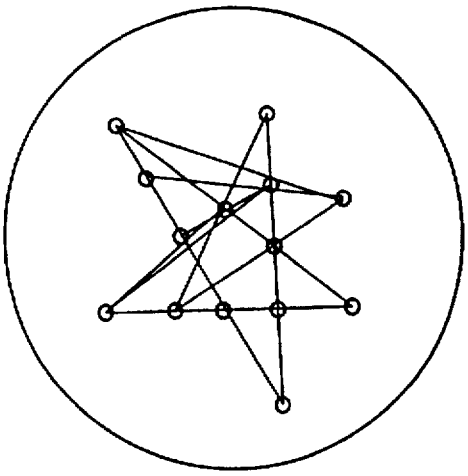
Figure 6D:
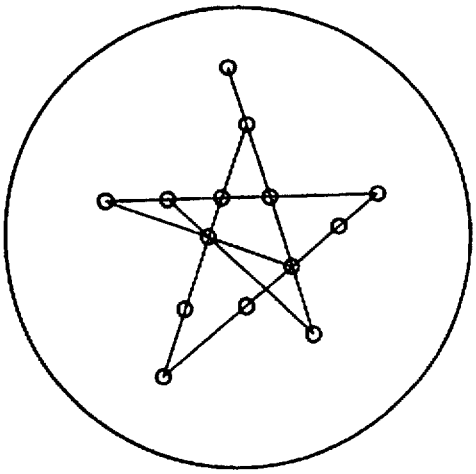
Figure 6E:
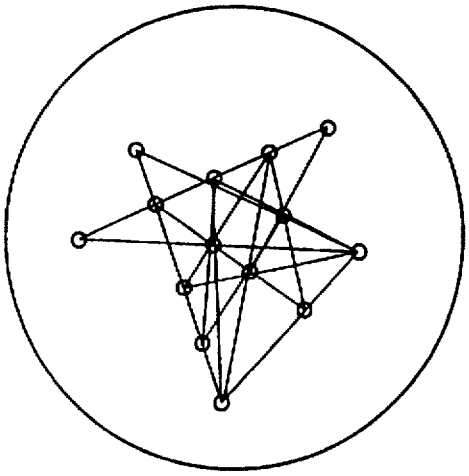
Figure 6F:
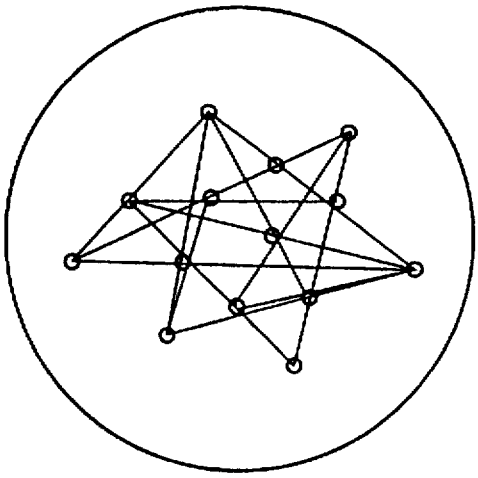
Figure 9A:
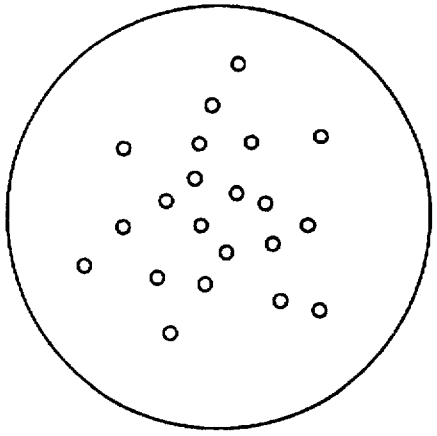
FIGS. 9A–9E illustrate exemplary embodiments of 21 peening particles arranged on a peening particle support.
Figure 9B:
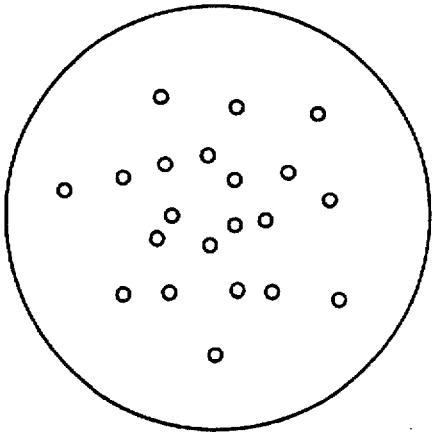
Figure 9C:
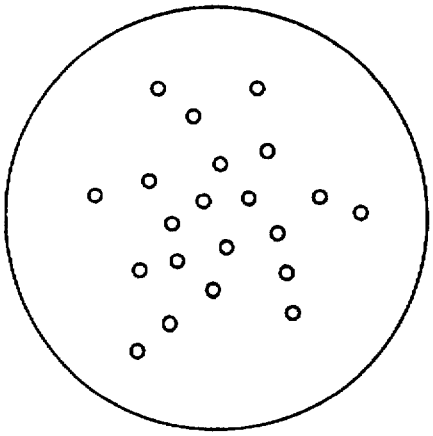
Figure 9D:
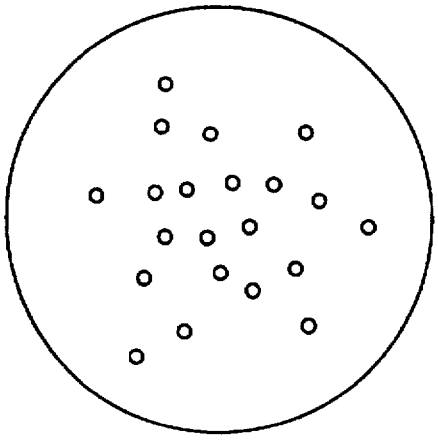
Figure 9E:
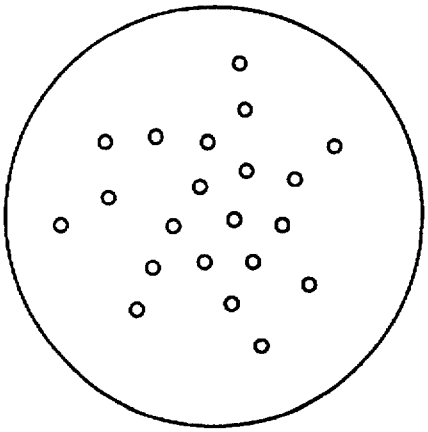

With the exception of the designs of FIGS. 6F and 9E, the designs in Tables 5 and 6 represent idealized designs that may not be practical to manufacture due to the size of the peening particles in relation the size of the peening particle support and the required minimum spacing between peening particles. Therefore, smaller peening particles may be required. Peening particles having diameters of about 1.68 mm (0.066 inches) are typically used on nine point designs and about 1.12 mm (0.044 inches) for twenty-one point designs.

TABLE 5

| Design | Point | 1 | 2 | 3 | 4 | 5 | 6 | 7 |
|---|---|---|---|---|---|---|---|---|
| 6A | Radius | .03 in | .0484 in | .0588 in | .0704 in | .0815 in | .0872 in | .103 in |
| | | .76 mm | 1.23 mm | 1.49 mm | 1.79 mm | 2.07 mm | 2.21 mm | 2.62 mm |
| | Angle | 104.1 | 217.01 | 171.65 | 312.27 | 264.94 | 42.42 | 345.33 |
| 6B | Radius | .03 in | .0451 in | .0578 in | .0696 in | .0809 in | .0921 in | .1034 in |
| | | .76 mm | 1.15 mm | 1.47 mm | 1.77 mm | 2.05 mm | 2.34 mm | 2.63 mm |
| | Angle | 106.98 | 346.27 | 180.42 | 54.18 | 262.34 | 301.28 | 231.6 |
| 6C | Radius | .032 in | .0449 in | .0563 in | .067 in | .0776 in | .0881 in | .0988 in |
| | | .81 mm | 1.14 mm | 1.43 mm | 1.70 mm | 1.97 mm | 2.24 mm | 2.51 mm |
| | Angle | 311.1 | 23.37 | 100.66 | 159.31 | 257.42 | 212.29 | 346.42 |
| 6D | Radius | .1105 in | .1585 in | .0555 in | .1219 in | .185 in | .0442 in | .0839 in |
| | | 2.81 mm | 4.03 mm | 1.41 mm | 3.10 mm | 4.70 mm | 1.12 mm | 2.13 mm |
| | Angle | 5.58 | 17.02 | 50.41 | 84.99 | 92.87 | 111.05 | 151.99 |
| 6E | Radius | .0241 in | .0432 in | .0568 in | .0686 in | .0785 in | .0909 in | .1017 in |
| | | .61 mm | 1.10 mm | 1.44 mm | 1.74 mm | 1.99 mm | 2.31 mm | 2.58 mm |
| | Angle | 201.23 | 292.41 | 23.15 | 107.96 | 226.51 | 156.59 | 67.65 |
| 6F | Radius | .035 in | .0514 in | .0648 in | .0768 in | .0881 in | .0991 in | .1098 in |
| | | .899 mm | 1.31 mm | 1.65 mm | 1.95 mm | 2.24 mm | 2.52 mm | 2.79 mm |
| | Angle | 0.0 | 123.1 | 204 | 268 | 63.7 | 317.3 | 20.48 |

| Design | Point | 8 | 9 | 10 | 11 | 12 | 13 | 14 |
|---|---|---|---|---|---|---|---|---|
| 6A | Radius | .1184 in | .124 in | .1398 in | .1458 in | .1569 in | .1683 in | .1805 in |
| | | 3.01 mm | 3.15 mm | 3.55 mm | 3.70 mm | 3.99 mm | 4.27 mm | 4.58 mm |
| | Angle | 144.49 | 70.92 | 192.27 | 282.07 | 233.91 | 3.59 | 134.17 |
| 6B | Radius | .1148 in | .1264 in | .1384 in | .1507 in | .1633 in | .1764 in | .19 in |
| | | 2.92 mm | 3.21 mm | 3.52 mm | 3.83 mm | 4.15 mm | 4.48 mm | 4.83 mm |
| | Angle | 146.61 | 18.85 | 74.7 | 329.9 | 210.5 | 136.99 | 286.3 |
| 6C | Radius | .1097 in | .1209 in | .1325 in | .1444 in | .1568 in | .1696 in | .183 in |
| | | 2.79 mm | 3.07 mm | 3.37 mm | 3.67 mm | 3.98 mm | 4.31 mm | 4.65 mm |
| | Angle | 58.87 | 293.63 | 187.1 | 127.8 | 245.96 | 48.78 | 334.54 |
| 6D | Radius | .1458 in | .03 in | .0971 in | .1715 in | .0754 in | .1338 in | .0677 in |
| | | 3.70 mm | .76 mm | 2.47 mm | 4.36 mm | 1.92 mm | 3.40 mm | 1.72 mm |
| | Angle | 165.16 | 182.96 | 234.97 | 242.32 | 277.88 | 307.84 | 330.99 |
| 6E | Radius | .1116 in | .1236 in | .1348 in | .1461 in | .1578 in | .1647 in | .185 in |
| | | 2.83 mm | 3.14 mm | 3.42 mm | 3.42 mm | 4.01 mm | 4.18 mm | 4.70 mm |
| | Angle | 312.14 | 253.61 | 352.06 | 136.08 | 50.14 | 180.82 | 265.64 |
| 6F | Radius | .1204 in | .1309 in | .1415 in | .1522 in | .1629 in | .1739 in | .185 in |
| | | 3.06 mm | 3.32 mm | 3.59 mm | 3.87 mm | 4.14 mm | 4.42 mm | 4.70 mm |
| | Angle | 160.18 | 235.36 | 102.35 | 291.72 | 45.07 | 188.54 | 348.32 |

TABLE 6

| Design | Point | 1 | 2 | 3 | 4 | 5 | 6 | 7 |
|---|---|---|---|---|---|---|---|---|
| 9A | Radius | .025 in | .0364 in | .0458 in | .0543 in | .0623 in | .0699 in | .0775 in |
| | | .64 mm | .92 mm | 1.16 mm | 1.38 mm | 1.58 mm | 1.76 mm | 1.97 mm |
| | Angle | 208.21 | 51.46 | 285.08 | 125.31 | 14.92 | 165.61 | 335.81 |
| 9B | Radius | .025 in | .0364 in | .0458 in | .0543 in | .0623 in | .0699 in | .0775 in |
| | | .64 mm | .92 mm | 1.16 mm | 1.38 mm | 1.58 mm | 1.78 mm | 1.97 mm |
| | Angle | 330.85 | 257.45 | 61.57 | 181.51 | 353.95 | 98.51 | 202.73 |
| 9C | Radius | .25 in | .0368 in | .463 in | .0549 in | .0628 in | .0705 in | .0779 in |
| | | 6.4 mm | .93 mm | 11.76 mm | 1.39 mm | 1.60 mm | 1.80 mm | 1.98 mm |
| | Angle | 130.7 | 290.46 | 29.46 | 187.45 | 85.37 | 225.63 | 346.92 |
| 9D | Radius | .025 in | .0364 in | .0458 in | .0543 in | .0623 in | .0699 in | .0775 in |
| | | .64 mm | .92 mm | 1.16 mm | 1.38 mm | 1.58 mm | 1.76 mm | 1.97 mm |
| | Angle | 232.89 | 347.6 | 68.94 | 137.76 | 271.36 | 195.76 | 32.26 |
| 9E | Radius | .024 in | .0403 in | .0503 in | .0592 in | .0675 in | .0754 in | .0831 in |
| | | .610 mm | 1.02 mm | 1.28 mm | 1.50 mm | 1.71 mm | 1.92 mm | 2.11 mm |
| | Angle | 346.5 | 115.9 | 195.3 | 259 | 55.3 | 308.6 | 351.3 |

| Design | Point | 8 | 9 | 10 | 11 | 12 | 13 | 14 |
|---|---|---|---|---|---|---|---|---|
| 9A | Radius | .0849 in | .0923 in | .0998 in | .1073 in | .1149 in | .1226 in | .1304 in |
| | | 2.16 mm | 2.34 mm | 2.53 mm | 2.73 mm | 2.92 mm | 3.11 mm | 3.31 mm |
| | Angle | 259.6 | 105.9 | 66.52 | 224.59 | 355.58 | 187.0 | 309.25 |
| 9B | Radius | .0849 in | .0923 in | .0998 in | .1073 in | .1149 in | .1226 in | .1304 in |
| | | 2.16 mm | 2.34 mm | 2.53 mm | 2.73 mm | 2.92 mm | 3.11 mm | 3.31 mm |
| | Angle | 136.98 | 287.26 | 29.2 | 238.05 | 307.64 | 159.7 | 79.67 |
| 9C | Radius | .0852 in | .0925 in | .0997 in | .107 in | .1143 in | .1217 in | .1291 in |
| | | 2.16 mm | 2.35 mm | 2.53 mm | 2.72 mm | 2.90 mm | 3.09 mm | 3.28 mm |
| | Angle | 267.42 | 152.69 | 51.43 | 323.13 | 212.3 | 103.8 | 10.8 |
| 9D | Radius | .0849 in | .0923 in | .0998 in | .1073 in | .1149 in | .1226 in | .1304 in |
| | | 2.16 mm | 2.34 mm | 2.53 mm | 2.73 mm | 2.92 mm | 3.11 mm | 3.31 mm |
| | Angle | 158.01 | 295.21 | 96.26 | 327.24 | 216.23 | 10.43 | 123.01 |

TABLE 6-continued

| | | | | | | | | |
|---|---|---|---|---|---|---|---|---|
| 9E | Radius | .0906 in<br>2.30 mm | .098 in<br>2.49 mm | .1054 in<br>2.68 mm | .1128 in<br>2.87 mm | .1201 in<br>3.05 mm | .1275 in<br>3.24 mm | .135 in<br>3.43 mm |
| | Angle | 94.9 | 222.2 | 24.7 | 281 | 126 | 170.71 | 74.72 |
| Design | Point | 15 | 16 | 17 | 18 | 19 | 20 | 21 |
| 9A | Radius | .1384 in<br>3.52 mm | .1465 in<br>3.72 mm | .1548 in<br>3.93 mm | .1633 in<br>4.15 mm | .172 in<br>4.37 mm | .1809 in<br>4.59 mm | .19 in<br>4.83 mm |
| | Angle | 95.02 | 146.87 | 247.43 | 38.53 | 319.41 | 200.21 | 83.24 |
| 9B | Radius | .1384 in<br>3.52 mm | .1465 in<br>3.72 mm | .1548 in<br>3.93 mm | .1633 in<br>4.15 mm | .172 in<br>4.37 mm | .1809 in<br>4.59 mm | .190 in<br>4.83 mm |
| | Angle | 7.43 | 219.25 | 116.35 | 270.24 | 44.85 | 326.57 | 171.8 |
| 9C | Radius | .1367 in<br>3.47 mm | .1444 in<br>3.67 mm | .1522 in<br>3.87 mm | .1602 in<br>4.07 mm | .1683 in<br>4.27 mm | .1766 in<br>4.49 mm | .185 in<br>4.70 mm |
| | Angle | 245.52 | 309.96 | 170.16 | 71.9 | 115.39 | 2.38 | 237.87 |
| 9D | Radius | .1384 in<br>3.52 mm | .1465 in<br>3.72 mm | .1548 in<br>3.93 mm | .1633 in<br>4.15 mm | .172 in<br>4.37 mm | .1809 in<br>4.59 mm | .19 in<br>4.83 mm |
| | Angle | 250.67 | 44.4 | 169.2 | 310.58 | 112.18 | 357.11 | 236.74 |
| 9E | Radius | .1426 in<br>3.62 mm | .1502 in<br>3.82 mm | .1579 in<br>4.01 mm | .1657 in<br>4.21 mm | .1737 in<br>4.41 mm | .1818 in<br>4.62 mm | .19 in<br>4.83 mm |
| | Angle | 322.43 | 232.49 | 145.15 | 30.93 | 289.39 | 184.3 | 80.67 |

EXAMPLE

Comparative Example.

Figure 3A:
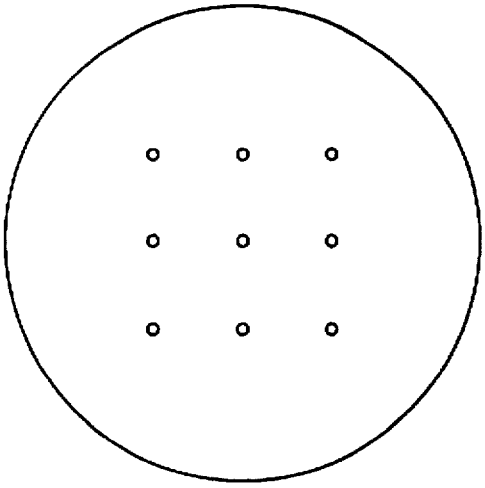
Fig. 3A PRIOR ART
FIGS. 3A–3D illustrate prior art arrangement of peening particles on a circular peening particle support.
Figure 7A:
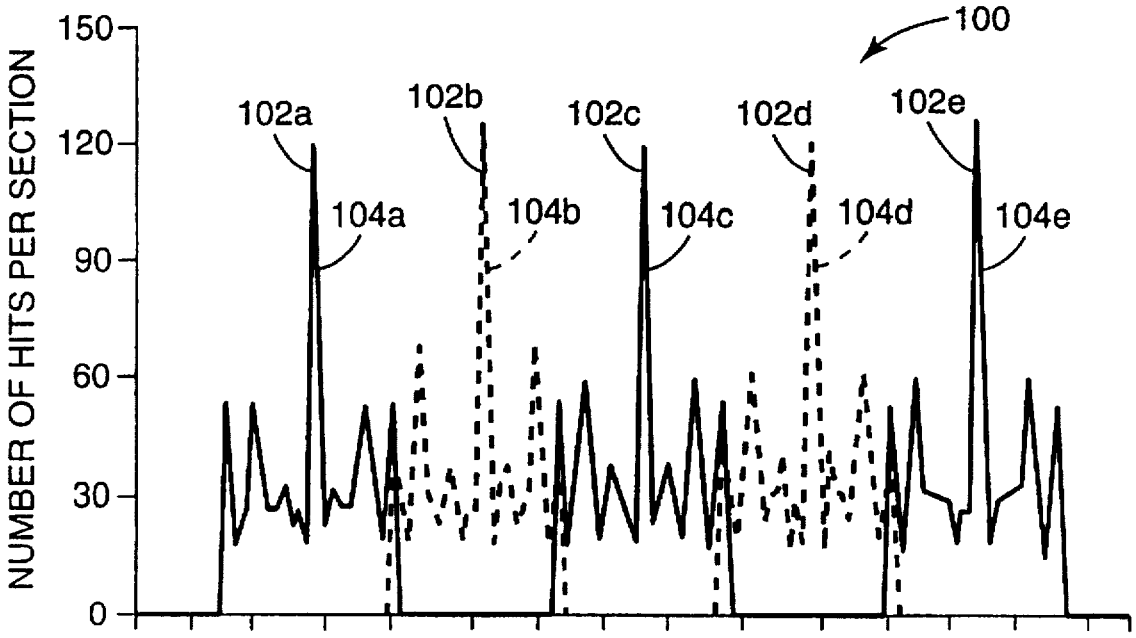
FIGS. 7A–7B are computer generated traces of surface profiles for a prior art peening particle configurations.

FIG. 7A illustrates a series of comparative computer generated graphs 100 showing the mathematically predicted number of hits per section of individual peening particles for five peening particle supports 102*a*–102*e*. The mathematical model assumes random angular orientation of the peening particle supports. For purposes of the graphs 100, there are 100 sections/2.54 cm (1 inch). The peening particle supports 102*a*–102*e* each contain nine peening particles arranged according to prior art design illustrated in FIG. 3A. The computer simulation is based upon a hub 12 containing 100 flaps 30 (to average the data) with two peening particle supports per flap and two flaps per flap slot 24. In the embodiment shown in FIG. 7A, peening particle supports 102*a*, 102*c*, and 102*e* are mounted to the hub 12 along a single flap slot 24. The centers of the peening particle supports 102*a*, 102*c*, and 102*e* are preferably separated by 1.27 mm (0.5 inches). The peening particle supports 102*b* and 102*d* are located in a subsequent flap slot 24, arranged so that the centers of the peening particle supports 102*a*, 102*c* and 102*e* are offset by 0.57 mm (0.25 inches) from the peening particle supports 102*b* and 102*d*.

Figure 3B:
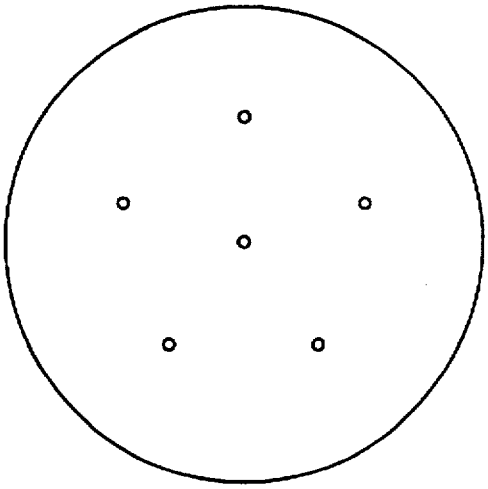
Fig. 3B PRIOR ART
Figure 3C:
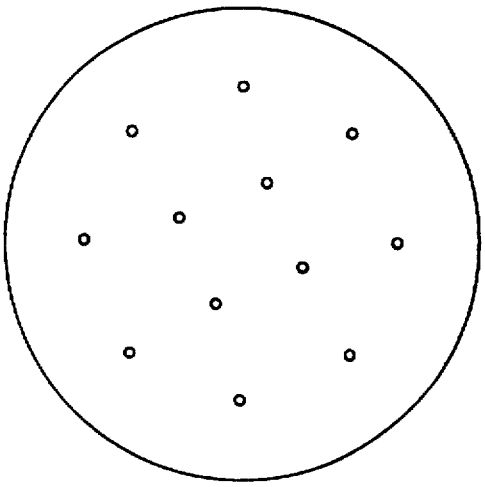
Fig. 3C PRIOR ART
Figure 3D:
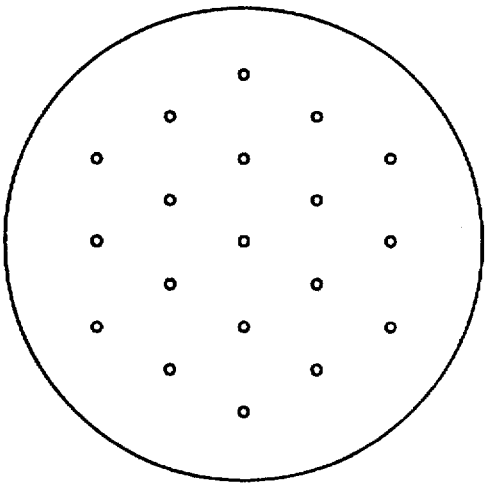
Fig. 3D PRIOR ART

The vertical axis of the graph shows the predicted number of hits per section. As shown in FIG. 3B, a peening particle is located in the center of each peening particle support 102*a*–102*e*. Regardless of the rotational orientation of the peening particle supports 102*a*–102*e*, the center peening particle will strike the same section for each rotation of the hub 12. Consequently, the graphs 100 shows a spike 104*a*–104*e* in the number of hits per section for each of the peening particle supports 102*a*–102*e*.

Figure 7B:
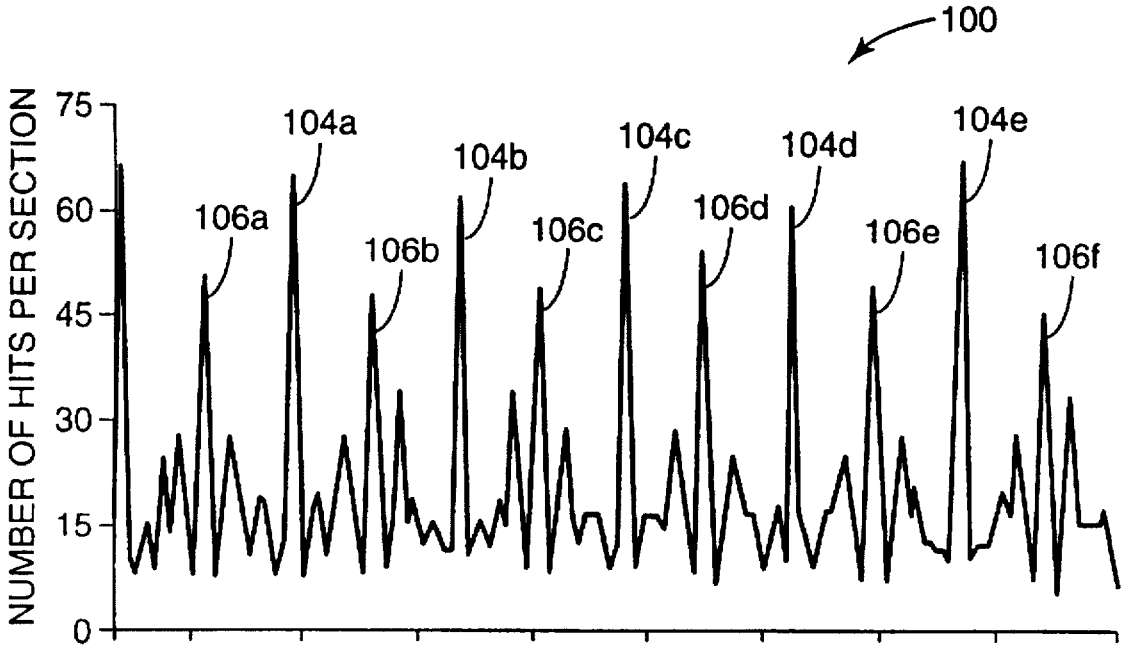

FIG. 7B is a composite graph of the individual graphs for the peening particle supports 102*a*–102*e* illustrated in FIG. 7A. In addition to the spikes 104*a*–104*e*, high points on the graphs 102*a*–102*e* combined to form additional spikes 106*a*–106*f*, plus a number of smaller spikes.

Figure 8A:
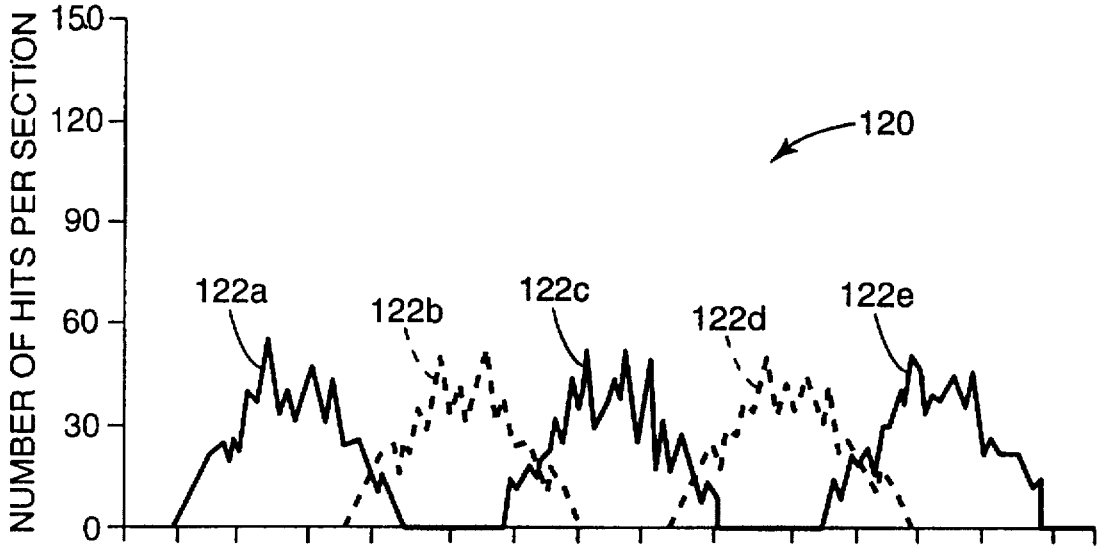
FIG. 8A–8B are computer generated traces of surface profiles for a peening particle configurations of the present invention.

FIG. 8A is a series of computer generated graphs 120 of an example showing the predicted number of hits per section of individual peening particles for five peening particle supports 122*a*–122*e*. The mathematical model assumes random angular orientation of the peening particle supports. For purposes of the graphs 120, there are 100 sections/2.54 cm (1 inch). The peening particle supports 122*a*–122*e* each contain nine peening particles arranged according to the design illustrated in FIG. 4A. The computer simulation is based upon a hub 12 containing 100 flaps 30 (to average the data) with two peening particle supports per flap and two flaps per flap slot 24. In the embodiment shown in FIG. 8A, peening particle supports 122*a*, 122*b*, and 122*c* are mounted to the hub 12 along a single flap slot 24. The centers of the peening particle supports 122*a*, 122*c* , and 122*e* are preferably separated by 1.27 mm (0.5 inches). The peening particle supports 122*b* and 122*d* are located in a subsequent flap slot 24 arranged so that the centers of the peening particle supports 122*a*, 122*c* and 122*e* are offset by 0.57 mm (0.25 inches) from the peening particle supports 122*b* and 122*d*.

Figure 8B:
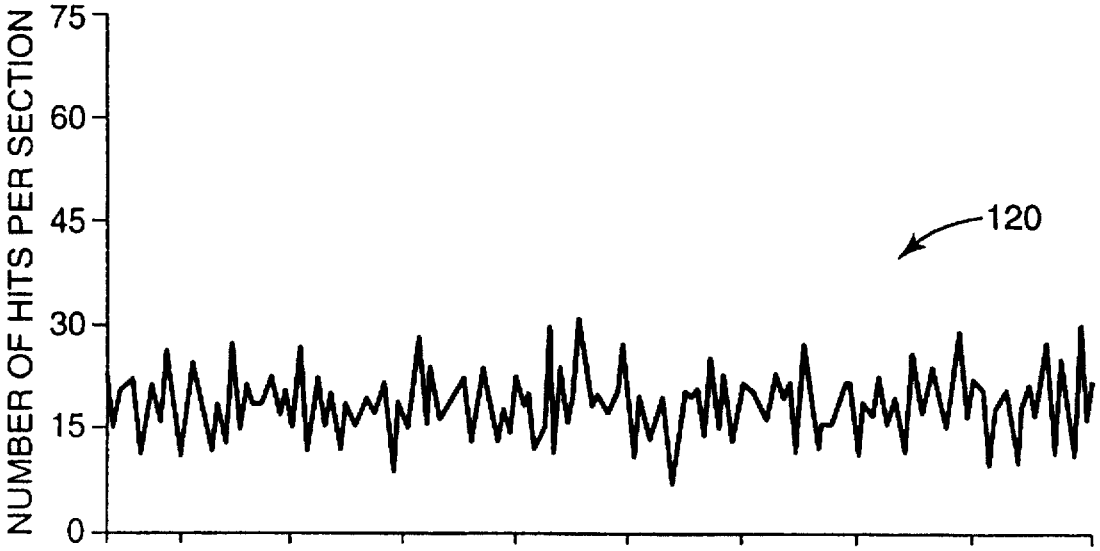

The vertical axis of the graph shows the predicted number of hits per section. As shown in FIG. 4A, no peening particle is located in the center of each peening particle support 122*a*–122*e*, thereby minimizing the chance of generating spikes such as shown in FIG. 7A. FIG. 8B is a composite graph of the individual graphs for the peening particle supports 122*a*–122*e* illustrated in FIG. 8A. The graphs 122*a*–122*e* tend to generate a surface substantially free of tracking.

All patents and patent applications cited herein are hereby incorporated by reference.

The present invention has now been described with reference to several embodiments thereof. It will be apparent to those skilled in the art that many changes can be made in the embodiments described without departing from the scope of the invention. Thus, the scope of the present invention should not be limited to the structures described herein, but rather by the structures described by the language of the claims, and the equivalents of those structures.

What is claimed is:

1. A peening particle support having a plurality of peening particles on an exposed surface thereof in an arrangement that minimizes tracking upon a workpiece, comprising:

a peening particle support having a center and an exposed surface, and at least 4 peening particles on said exposed surface, wherein each of said peening particles is located at a respective peening particle radius with respect to said center, and wherein said peening particles are arranged such that at each respective non-zero peening particle radius at which at least one peening particle is located, there are from 1 to 3 peening particles.

2. The article of claim 1, wherein said peening particles are arranged such that at each respective non-zero peening particle radius at which at least one peening particle is located, there are from 1 to 2 peening particles.

3. The article of claim 1 wherein said peening particles are arranged such that at each respective non-zero peening particle radius at which at least one peening particle is located, there is only 1 peening particle.

4. The article of claim 1 wherein said peening particles are arranged such that each of said peening particles is located at a non-zero peening particle radius.

5. The article of claim 1 said peening particles are arranged in an asymmetrical arrangement.

6. The article of claim 1 wherein the peening particle arrangement further comprises at least one generally linear array of peening particles.

7. The article of claim 6 wherein said at least one linear array comprises at least three peening particles.

8. The article of claim 6 wherein said linear array comprises all of said peening particles.

9. The article of claim 6 wherein a distance of each of said peening particles from a best fit line in said at least one linear array comprises less than 0.51 mm for a peening particle support containing six peening particles.

10. The article of claim 6 wherein a distance of each of said peening particles from a best fit line in said at least one linear array comprises less than 0.381 mm for a peening particle support containing nine peening particles.

11. The article of claim 6 wherein a distance of each of said peening particles from a best fit line in said at least one linear array comprises less than 0.254 mm for a peening particle support containing fourteen peening particles.

12. The article of claim 6 wherein a distance of each of said peening particles from a best fit line in said at least one linear array comprises less than 0.127 mm for a peening particle support containing twenty-one peening particles.

13. The article of claim 1 wherein said exposed surface comprises a generally circular shape.

14. The article of claim 1 wherein said exposed surface has a diameter of about 1.04 cm to 1.27 cm.

15. The article of claim 1 wherein said peening particles have a diameter of about 1.02 mm to 1.63 mm.

16. The article of claim 1 wherein said plurality of peening particles comprises between six and twenty one peening particles on said exposed surface.

17. The article of claim 1 wherein said peening particles are metallurgically attached to said exposed surface.

18. An elongated strap of a flexible tear resistance material having a peening particle support of claim 1 attached to a distal end thereof.

19. The article of claim 18 wherein two or more peening particle supports having different peening particle arrangements are attached to said distal end thereof.

20. A rotary peening apparatus comprising a plurality of the peening particle supports of claim 1.

21. The article of claim 20 wherein two or more of said peening particle supports have different peening particle arrangements.

22. The article of claim 1, further including a plurality of dimples formed in said exposed surface, equal in number to said plurality of peening particles, each of said dimples receiving one of said peening particles.

23. A peening particle support having a plurality of peening particles on an exposed surface thereof in an arrangement that minimizes tracking upon a workpiece, comprising:

a peening particle support having a center and an exposed surface, and at least 4 peening particles on said exposed surface, wherein each of said peening particles is located at a respective peening particle radius with respect to said center, and wherein said peening particles are arranged such that at each respective non-zero peening particle radius at which at least one peening particle is located, there are from 1 to 3 peening particles; and wherein said peening particles are arranged into at least one generally linear array.

24. A high-intensity peening flap construction comprising:

an elongated strap of a flexible resilient tear-resistant material having a high flexural endurance and shape retention;

at least one peening particle support base mechanically fastened to the elongated strap adjacent one end thereof, the support base being formed of a metal having the ability to withstand high bending and impact stress while resisting deformation, and at least 4 peening particles arranged on an exposed face of the support base, wherein said peening particles are arranged such that at each respective non-zero peening particle radius at which at least one peening particle is located, there are from 1 to 3 peening particles.

25. The article of claim 24, wherein said peening particles are arranged such that at each respective non-zero peening particle radius at which at least one peening particle is located, there are from 1 to 2 peening particles.

26. The article of claim 25 wherein said peening particles are arranged such that each peening particle has a substantially different peening particle radius.

* * * * *

UNITED STATES PATENT AND TRADEMARK OFFICE

CERTIFICATE OF CORRECTION

PATENT NO. : 5,758,531
DATED : June 2, 1998
INVENTOR(S) : Timothy L. Graf

It is certified that error appears in the above-identified patent and that said Letters Patent is hereby corrected as shown below:

Column 7,
Line 7, "particle support in other words," should read -- particle support. In other words, --.
Line 9, "article" should read -- particle --.
Line 10, "articles." should read -- particles. --

Signed and Sealed this

Twelfth Day of March, 2002

*Attest:*

*Attesting Officer*

JAMES E. ROGAN
*Director of the United States Patent and Trademark Office*